US010499468B1

(12) United States Patent
Felty et al.

(10) Patent No.: US 10,499,468 B1
(45) Date of Patent: Dec. 3, 2019

(54) METHOD FOR STEP DIMMING

(71) Applicant: Current Lighting Solutions, LLC, East Cleveland, OH (US)

(72) Inventors: Jeffrey Glenn Felty, Elyria, OH (US); Kevin Andrew Candow, Lakewood, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 16/248,048

(22) Filed: Jan. 15, 2019

(51) Int. Cl.
*H05B 37/00* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC . H01J 61/56; H01J 61/90; H01J 61/50; H05B 41/32; H05B 33/06; H05B 33/0803; H05B 41/28; H05B 41/295; H05B 41/2827; H05B 41/3925; H05B 37/02; H05B 37/04; H05B 39/09; H05B 37/0263; H05B 37/029; H05B 37/0254; H05B 37/0245; F21K 9/00; F21V 23/02; H01K 1/625; H01K 1/66; B63C 9/20; A01K 63/06; B60Q 1/387; B60Q 1/44; B60Q 1/18; Y02B 20/202; H02J 9/005; B64F 1/20; G04C 23/16; F21W 2131/406; H04N 9/3141
See application file for complete search history.

(56) References Cited

U.S. PATENT DOCUMENTS 5,834,899 A * 11/1998 Lovell ..... H01J 61/56 315/41
2002/0074953 A1* 6/2002 Lovell ..... H01J 61/56 315/248
2016/0377246 A1* 12/2016 Simmons ..... F21S 9/024 362/20

* cited by examiner

*Primary Examiner* — Minh D A
(74) *Attorney, Agent, or Firm* — Buckley, Maschoff & Talwalkar, LLC

(57) ABSTRACT

A control circuit for a step dimming circuit includes a first line power lead, a second line power lead, a first relay pole, powered by the first line power lead, for switching power from the first and second line power leads to a power supply line, a second relay pole powered by the first line power lead and connected to a first control lead, a third relay pole powered by the second line power lead and connected to a second control lead and connected to the second relay pole, where the second and third relay poles are configured to connect the first and second control leads together when only one of the second and third relay poles are powered, and where the second and third relay poles are configured to disconnect the first and second control leads when both of the second and third relay poles are powered.

21 Claims, 4 Drawing Sheets

METHOD FOR STEP DIMMING

FIELD

The disclosed exemplary embodiments relate generally to light emitting diode (LED) lighting systems, and more particularly to providing a step dimming function for LED lighting systems.

BACKGROUND

Many different types of lighting-control systems have been developed to help reduce energy waste, while still providing acceptable lighting levels. Dimming lighting controls may reduce lighting energy consumption and produce energy savings, while allowing a user to adjust the intensity of a light source to a desired level. Step dimming controls may allow a user to selectively operate a light source at at least two different outputs, typically at a full power output and at a less than full power output.

Two wall switches may be used in typical step dimming applications, each providing mains power through line power leads, also referred to as "hot" or "active" leads, to a light source. When both switches are in the "on" position, power is provided from the two line power leads, resulting in full light output. If one switch is in the "off" position, thus disconnecting the mains from one of the line power leads, the power is provided from the remaining connected line power lead, resulting in a dimmed light level.

U.S. Pat. No. 8,072,158, issued on Dec. 6, 2011, discloses a step dimming circuit that includes a diode bridge, an opto-isolator, and various discrete resistors and capacitors components. However, the disclosed step dimming circuit has a relatively large number of components, requiring a correspondingly large number of interconnections.

In order to utilize two switch step dimming in LED applications, a special driver that utilizes two line power lead lines may be required. Furthermore, even with a special driver, the two line power leads are typically required to have the same phase because applying different phases to the special driver at the same time may result in the applied voltage exceeding the voltage limitations of the special driver, leading to possible unreliable operation or failure. The possibility of providing different phases to the special driver may present a particular risk in retrofit applications where the exact wiring configuration may be unknown. Another solution might include using two LED drivers, each operating on a different phase. However, this would incur the cost of two LED drivers and complicated connections between the LED drivers and the LED light source.

It would be advantageous to provide step dimming for LED applications that utilizes fewer components and a standard LED driver with control leads as opposed to a special step dimming driver.

SUMMARY

As described herein, the exemplary embodiments overcome one or more of the above or other disadvantages known in the art.

The disclosed embodiments are directed to a control circuit for a step dimming circuit, including a first line power lead, a second line power lead, a first relay pole, powered by the first line power lead, for switching power from the first and second line power leads to a power supply line, a second relay pole powered by the first line power lead and connected to a first control lead, a third relay pole powered by the second line power lead and connected to a second control lead and connected to the second relay pole, wherein the second and third relay poles are configured to connect the first and second control leads together when only one of the second and third relay poles are powered, and wherein the second and third relay poles are configured to disconnect the first and second control leads when both of the second and third relay poles are powered.

The disclosed embodiments are also directed to a step dimming method including providing power to a first relay pole for switching power from a first line power lead and a second line power lead to an LED driver power input line, using a second relay pole connected to a first control lead of the LED driver and using a third relay pole connected to a second control lead of the LED driver to connect the first and second control leads together when power is provided to only one of the second and third relay poles, and using the second and third relay poles to disconnect the first and second control leads when power is provided to both of the second and third relay poles.

The disclosed embodiments are further directed to a step dimming circuit including a first line power lead, a second line power lead, an LED driver with a power input and first and second control inputs, a first relay pole, powered by the first line power lead, for switching power from the first and second line power leads to the power input of the LED driver, a second relay pole powered by the first line power lead and connected to the first control input, a third relay pole powered by the second line power line and connected to the second control input and to the second relay pole, wherein the second and third relay poles are configured to connect the first and second control inputs together when only one of the second and third relay poles are powered, wherein the LED driver is programmed to provide a less than full driver output when the first and second control leads are connected, wherein the second and third relay poles are configured to disconnect the first and second control inputs when both of the second and third relay poles are powered, and wherein the LED driver is programmed to provide a full driver output when the first and second control leads are disconnected.

The disclosed embodiments are still further directed to a step dimming method, including providing power to a first relay pole for switching power from a first line power lead and a second line power lead to an LED driver power input line, where the first and second line power leads are connected to different phases of a multi-phase power system, using a second relay pole connected to a first control lead of the LED driver and using a third relay pole connected to a second control lead of the LED driver to connect the first and second control leads together when power is provided to only one of the second and third relay poles, and using the second and third relay poles to disconnect the first and second control leads when power is provided to both of the second and third relay poles.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DETAILED DESCRIPTION

Figure 1:
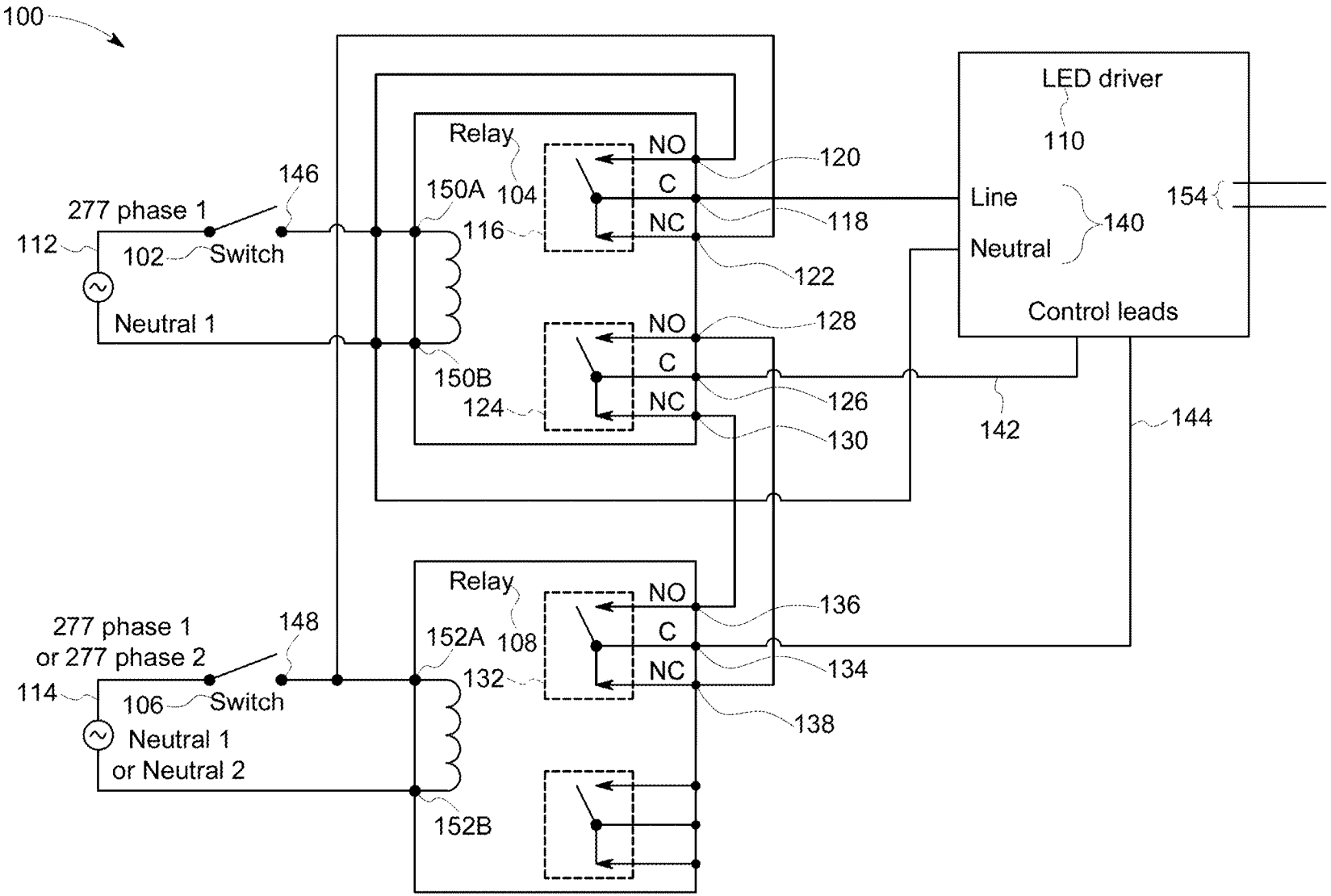
FIGS. 1-4 illustrate an exemplary step dimming circuit according to the disclosed embodiments.

FIG. 1 shows an exemplary step dimming circuit 100 according to the disclosed embodiments. Step dimming circuit 100 may at least include a first switch 102, a first relay 104, a second switch 106, a second relay 108, and an LED driver 110.

First and second switches 102, 106 may be single throw switches or any switches suitable for switching mains power, for example, generally 90-277 VAC at between approximately 15-30 amperes. First switch 102 may operate to connect a first line power lead 112 to the first relay 104 of the step dimming circuit 100 and second switch 106 may operate to connect a second line power lead 114 to the first relay 104 of the step dimming circuit 100. The first and second line power leads 112, 114 may provide power from the same or different phases of a multi-phase system.

First and second relays 104, 106, may be form-c double pole double throw relays. In some embodiments, second relay 106 may be a form-c single pole double throw relay. First and second relays 104, 106 may operate in a "break before make" fashion. In the exemplary embodiment illustrated in FIG. 1, first relay 104 may have a coil input 150A, 150B, a first pole 116 with common 118, normally open 120, and normally closed 122 contacts, and a second pole 124 with common 126, normally open 128, and normally closed 130 contacts. Second relay 108 may have coil input 152A, 152B, and a first pole 132 with common 134, normally open 136, and normally closed 138 contacts. The coil inputs for both relays 104, 108 may have an input voltage rating that matches the phase voltage of the first and second line power leads 112, 114, respectively, for example, approximately 277 VAC.

In embodiments where the first and second line power leads 112, 114 provide power from the same phase, the common, normally open, and normally closed contacts of the relays 104, 108 may have a voltage rating at a minimum corresponding to the voltage supplied by the first and second line power leads 112, 114. In embodiments where the first and second line power leads 112, 114 provide power from different phases, the common, normally open, and normally closed contacts of the relays 104, 108 may have a voltage rating of at least $\sqrt{2-2\cos(\alpha)}\times$ the voltage provided by the first and second line power leads 112, 114, where a represents the phase difference. For example, for a 2 phase system, a=180°, and for a 3 phase system, a=120°. The current rating for the common, normally open, and normally closed contacts of the relays 104, 108 may correspond to the input current of the LED driver 110, which may be, for example, less than approximately 15 A. It should be understood that first and second relays 104, 108 may be any relays capable of performing the switching described herein.

The LED driver 110 may be an AC input LED driver, may also be referred to as an offline LED driver, and may have an AC input 140 capable of operating with approximately between 90-277 VAC at approximately between 45-65 Hertz. The LED driver may have a DC output which may provide, for example, 5-280 volts at 0-15 amps for driving an LED light source. The LED driver 110 may also have first and second control inputs 142, 144 which, when unconnected or open circuit, may cause the LED driver to provide full driver output. When first and second control inputs 142, 144 are shorted together, they may cause the LED driver 110 to provide less than full driver output. In some embodiments, the first and second control inputs may also be configured as a 0-10 volt input, while also operating to cause the LED driver to provide full driver output when open and provide less than full driver output when shorted. The amount of driver output provided when the first and second control inputs 142, 144 are open, and the amount of driver output provided when the first and second control inputs 142, 144 are shorted together may be programmable.

Figure 2:
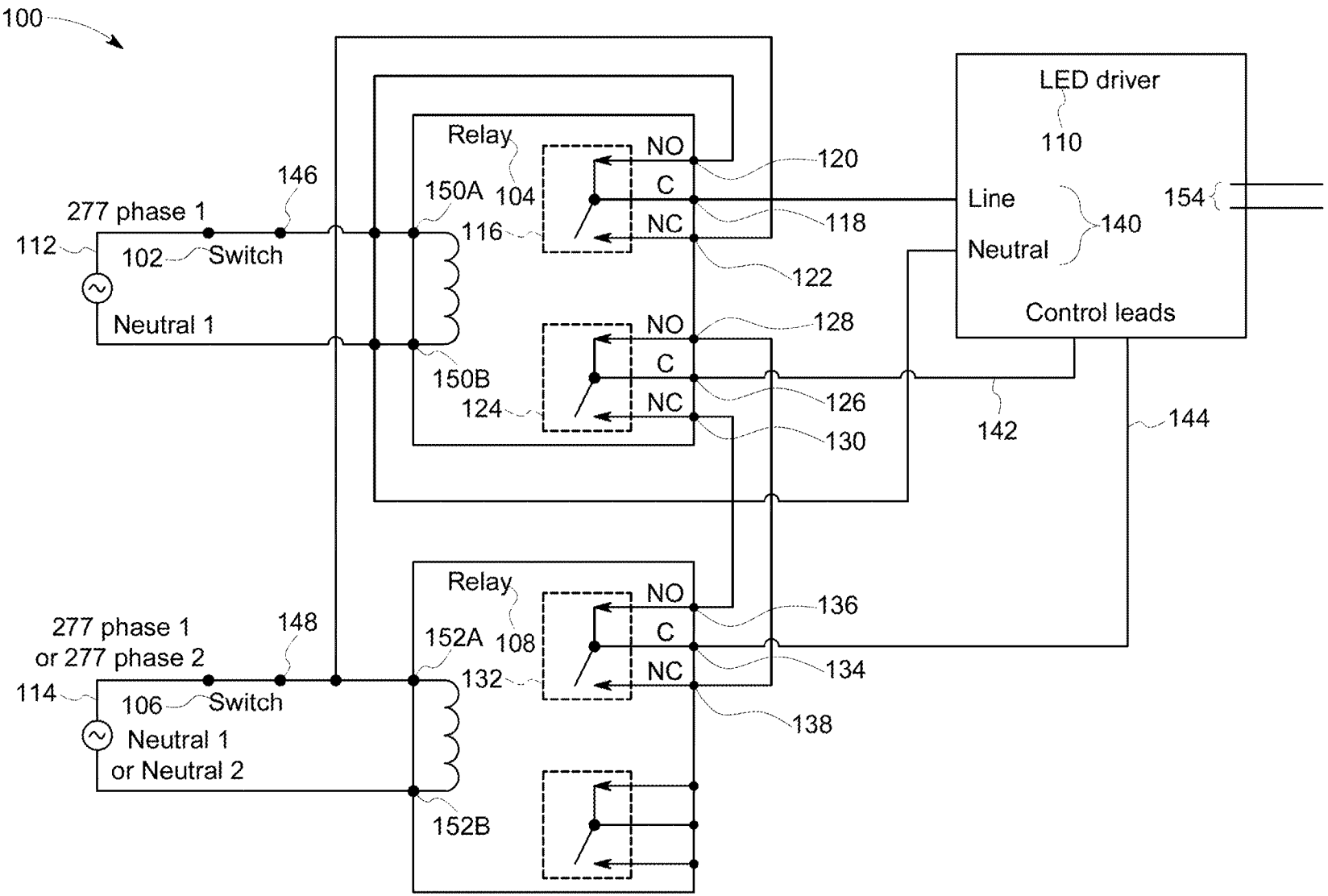
Figure 3:
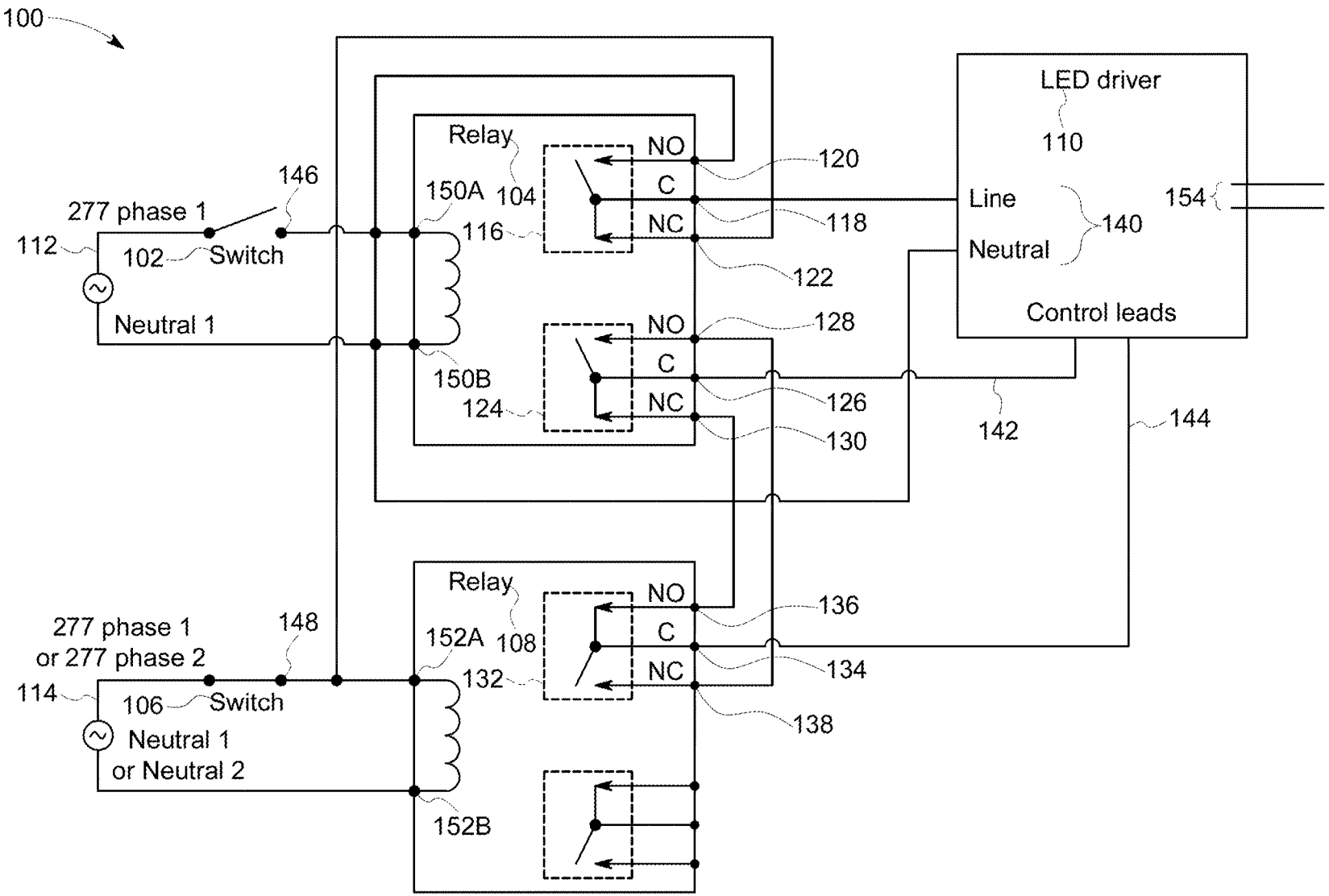
Figure 4:
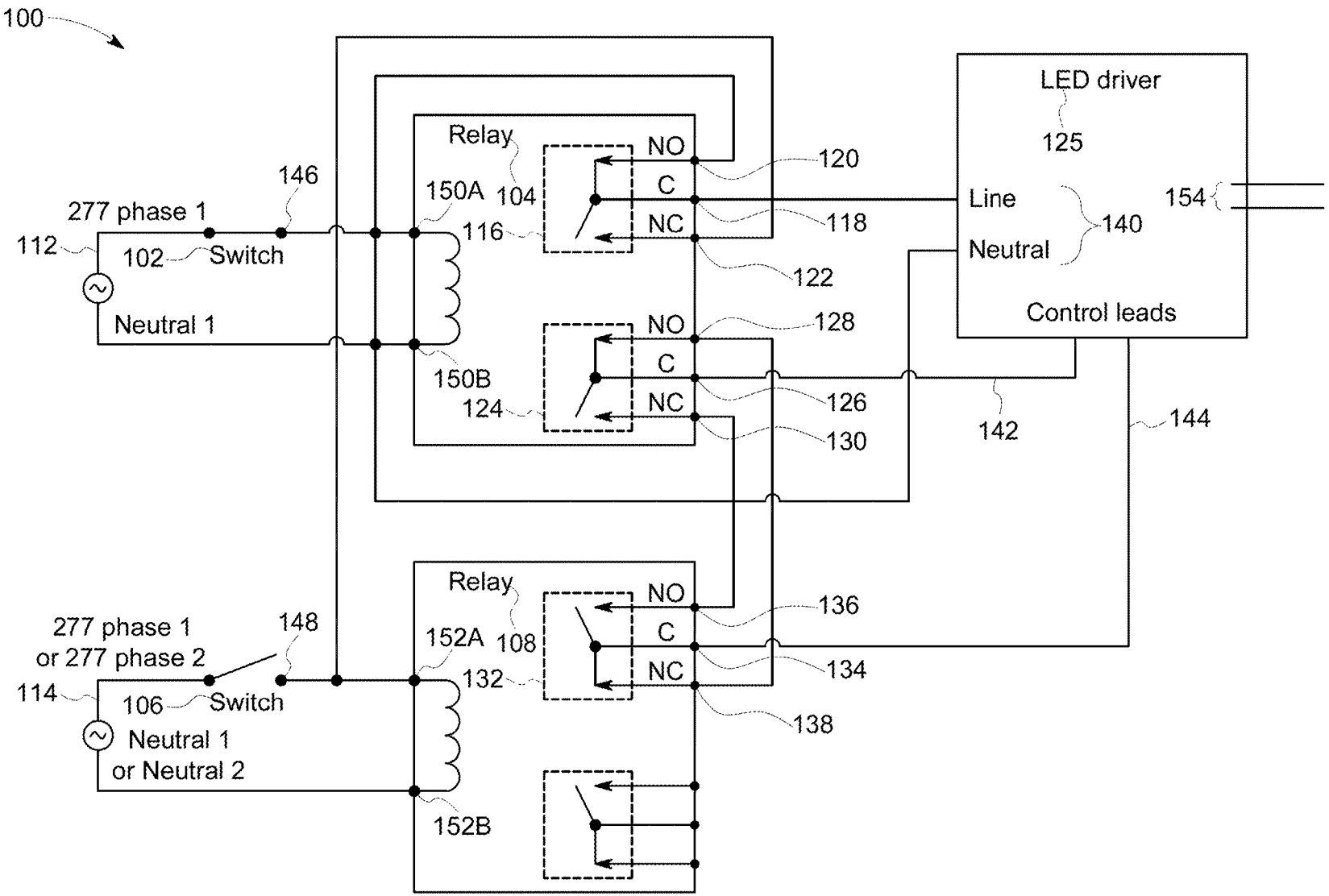

The general operation of the step dimming circuit 100 may be described with respect to FIGS. 1-4. Referring to FIG. 4, a first terminal 146 of switch 102 may be connected to the normally open contact 120 of pole 116 of relay 104, and a first terminal 148 of switch 106 may be connected to the normally closed contact 122 of pole 116. When switch 102 is closed and switch 106 is open, relay 104 may be energized, the normally open contact 120 may be connected to the common contact 118, and power may be provided to the LED driver 110 from switch 102. Referring to FIG. 3, when switch 102 is open and switch 106 is closed, relay 104 may not be energized, the normally closed contact 122 may be connected to the common contact 118, and power may be provided to the LED driver 110 from switch 106. In this manner, the contacts of pole 116 may provide an OR function for providing power to the LED driver 110. Thus, if either switch 102, 106 or both switches 102, 106 are closed, power may be provided to the LED driver 110.

The dimming action for step dimming may be provided by the contacts of pole 124 of relay 104 and pole 132 of relay 108. Control leads 142, 144 of the LED driver 110 may be connected to common contact 126 of pole 124 and common contact 134 of pole 132, respectively. Referring to FIG. 2, when both switches 102, 106 are closed, both relay 104 and relay 108 may be energized, causing the normally open and common contacts to be connected and the control leads 142 and 144 to be disconnected and open circuit, resulting in the LED driver providing full driver output. When either or both switches 102, 16 are open, as shown in FIGS. 1, 3, and 4, the control leads 142 and 144 may be connected and shorted, resulting in the LED driver providing less than full driver output. In this manner, the contacts of pole 124 of relay 104 and the contacts of pole 132 of relay 108 may provide an "XOR" function for the control leads 142, 144 of the LED driver 110.

A detailed explanation of the operation of the step dimming circuit 100 as shown in FIGS. 1-4 will now be provided. FIG. 1 illustrates the operation of the step dimming circuit 100 when both switches 102, 106 are open. With both switches 102, 106 open, no power from first or second line power leads 112, 114 may be provided to the step dimming circuit 100, and relays 104, 108 may not be energized. Thus, the normally closed contact of each relay pole may be connected to the respective common contact, and the normally open contact of each relay pole may be disconnected from the respective common contact. With both switches 102, 106 open, control lead 142 may be connected to the normally open contact 136 of pole 132 of relay 108, and control lead 144 may be connected to the normally open contact 128 of pole 124 of relay 104. In addition, no power may be supplied to the AC input 140 of the LED driver 110 and thus the LED driver 110 may provide no driver output.

FIG. 2 illustrates the operation of the step dimming circuit 100 when both switches 102, 106 are closed. With switch 102 closed, power from first line power lead 112 may be provided to energize relay 104 and may be provided to the AC input 140 of the LED driver 110 through the normally open contact 120 connected to the common contact 118 of pole 116 of relay 104. With switch 106 closed, power from second line power lead 114 may be provided to energize relay 108. With relays 104, 108 energized, the normally open contact 128 of pole 124 may be connected to the common contact 126, the normally closed contact 130 may be disconnected from the common contact 126, the normally open contact 136 of pole 132 may be connected to the common contact 134, and the normally closed contact 138 may be disconnected from common contact 134. As a result, control lead 142 may be connected to normally closed contact 138 of pole 132 of relay 108, which may be open, and control lead 144 may be connected to normally closed contact 130 of pole 124 of relay 104, which may also be open. Because the control leads 142, 144 are disconnected, the LED driver provides full driver output.

FIG. 3 illustrates the operation of the step dimming circuit 100 when switch 102 is open and switch 106 is closed. With switch 102 open, no power from first line power lead 112 may be provided to the step dimming circuit 100 and relay 104 may not be energized. With switch 106 closed, power may be provided to the AC input 140 of the LED driver 110 from second power lead line 114 through the normally closed contact 122 connected to the common contact 118 of pole 116 of relay 104. With switch 106 closed, power from second line power lead 114 may also be provided to energize relay 108. With no power applied to relay 104 and relay 108 energized, the normally open contact 128 of pole 124 may be disconnected from the common contact 126, the normally closed contact 130 may be connected to the common contact 126, the normally open contact 136 of pole 132 may be connected to the common contact 134, and the normally closed contact 138 may be disconnected from common contact 134. As a result, control lead 142 may be connected to normally closed contact 130 of pole 124 of relay 104, which may be connected to normally open contact 136 of pole 132 of relay 108, which may be connected to control lead 144 through common contact 134 of pole 132. Because the control leads 142, 144 are connected, the LED driver provides a dimmed output, reduced from the full driver output.

FIG. 4 illustrates the operation of the step dimming circuit 100 when switch 102 is closed and switch 106 is open. With switch 102 closed, power from first line power lead 112 may be provided to energize relay 104 and may be provided to the AC input 140 of the LED driver 110 through the normally open contact 120 connected to the common contact 118 of pole 116 of relay 104. With switch 106 open, no power from second line power lead 114 may be provided to the step dimming circuit 100 and relay 108 may not be energized. With relay 104 energized and no power applied to relay 108, the normally open contact 128 of pole 124 may be connected to the common contact 126, the normally closed contact 130 may be disconnected from the common contact 126, the normally open contact 136 of pole 132 may be disconnected from the common contact 134, and the normally closed contact 138 may be connected to the common contact 134. As a result, control lead 142 may be connected to normally open contact 128 of pole 124 of relay 104, which may be connected to normally closed contact 138 of pole 132 of relay 108, which may be connected to control lead 144 through common contact 134 of pole 132. Because the control leads 142, 144 are connected, the LED driver provides a dimmed output, reduced from the full driver output.

Thus, the disclosed step dimming embodiments advantageously utilize dual relays with a standard, readily available LED driver to realize a circuit that may be used with the same or different AC phases, without requiring a driver specially designed with dual AC inputs and without requiring AC input from the same phase.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Various features of the different embodiments described herein are interchangeable, one with the other. The various described features, as well as any known equivalents can be mixed and matched to construct additional embodiments and techniques in accordance with the principles of this disclosure.

Furthermore, some of the features of the exemplary embodiments could be used to advantage without the corresponding use of other features. As such, the foregoing description should be considered as merely illustrative of the principles of the disclosed embodiments and not in limitation thereof.

The invention claimed is:

1. A control circuit for a step dimming circuit, comprising:

a first line power lead;

a second line power lead;

a first relay pole, powered by the first line power lead, for switching power from the first and second line power leads to a power supply line;

a second relay pole powered by the first line power lead and connected to a first control lead;

a third relay pole powered by the second line power lead and connected to a second control lead and connected to the second relay pole, wherein the second and third relay poles are configured to connect the first and second control leads together when only one of the second and third relay poles are powered, and wherein the second and third relay poles are configured to disconnect the first and second control leads when both of the second and third relay poles are powered.

2. The step dimming circuit of claim 1, wherein the first and second line power leads are connected to a same phase of a multi-phase power system.

3. The step dimming circuit of claim 1, wherein the first and second line power leads are connected to different phases of a multi-phase power system.

4. The step dimming circuit of claim 1, connected to a first switch for connecting the first line power lead to a relay coil of the first and second relay poles for powering the first and second relay poles, and connected to a second switch for connecting the second line power lead to a relay coil of the third relay pole for powering the third relay pole.

5. The step dimming circuit of claim 4, wherein closing one of the first switch and the second switch causes the second and third relay poles to connect the first and second control leads together.

6. The step dimming circuit of claim 4, wherein closing both the first switch and the second switch causes the second and third relay poles to disconnect the first and second control leads.

7. The step dimming circuit of claim 1, connected to an LED driver by the power supply line connected to a power input of the LED driver and connected to the LED driver by the first control lead connected to a first control input of the LED driver and the second control lead connected to a second control input of the LED driver.

8. The step dimming circuit of claim 7, wherein the LED driver is programmed to provide a full driver output when the first and second control leads are disconnected.

9. The step dimming circuit of claim 7, wherein the LED driver is programmed to provide a less than full driver output when the first and second control leads are connected together.

10. A step dimming method, comprising:

providing power to a first relay pole for switching power from a first line power lead and a second line power lead to an LED driver power input line;

using a second relay pole connected to a first control lead of the LED driver and using a third relay pole connected to a second control lead of the LED driver to connect the first and second control leads together when power is provided to only one of the second and third relay poles; and using the second and third relay poles to disconnect the first and second control leads when power is provided to both of the second and third relay poles.

11. The step dimming method of claim 10, comprising connecting the first and second line power leads to a same phase of a multi-phase power system.

12. The step dimming method of claim 10, comprising connecting the first and second line power leads to different phases of a multi-phase power system.

13. The step dimming method of claim 10, comprising:

using a first switch to connect the first line power lead to a relay coil of the second relay pole to provide power to the second relay pole; and using a second switch to connect the second line power lead to a relay coil of the third relay pole for providing power to the third relay pole.

14. The step dimming method of claim 13, comprising closing one of the first switch and the second switch to cause the second and third relay poles to connect the first and second control leads together.

15. The step dimming method of claim 13, comprising closing both the first switch and the second switch to cause the second and third relay poles to disconnect the first and second control leads.

16. The step dimming method of claim 10, comprising programming the LED driver to provide a full driver output when the first and second control leads are disconnected.

17. The step dimming method of claim 10, comprising programming the LED driver to provide a less than full driver output when the first and second control leads are connected together.

18. A step dimming circuit, comprising:

a first line power lead;

a second line power lead;

an LED driver with a power input and first and second control inputs;

a first relay pole, powered by the first line power lead, for switching power from the first and second line power leads to the power input of the LED driver;

a second relay pole powered by the first line power lead and connected to the first control input;

a third relay pole powered by the second line power line and connected to the second control input and to the second relay pole, wherein the second and third relay poles are configured to connect the first and second control inputs together when only one of the second and third relay poles are powered, wherein the LED driver is programmed to provide a less than full driver output when the first and second control leads are connected, wherein the second and third relay poles are configured to disconnect the first and second control inputs when both of the second and third relay poles are powered, and wherein the LED driver is programmed to provide a full driver output when the first and second control leads are disconnected.

19. The step dimming circuit of claim 18, wherein the first and second line power leads are connected to a same phase of a multi-phase power system.

20. The step dimming circuit of claim 18, wherein the first and second line power leads are connected to different phases of a multi-phase power system.

21. A step dimming method, comprising:

providing power to a first relay pole for switching power from a first line power lead and a second line power lead to an LED driver power input line, wherein the first and second line power leads are connected to different phases of a multi-phase power system;

using a second relay pole connected to a first control lead of the LED driver and using a third relay pole connected to a second control lead of the LED driver to connect the first and second control leads together when power is provided to only one of the second and third relay poles; and using the second and third relay poles to disconnect the first and second control leads when power is provided to both of the second and third relay poles.

* * * * *